United States Patent [19]

Armand et al.

[11] Patent Number: 4,657,643

[45] Date of Patent: Apr. 14, 1987

[54] PROCESS FOR CONTINUOUSLY CONTROLLING THE PROPORTION OF METAL DISSOLVED IN A BATH OF MOLTEN SALTS AND THE APPLICATION THEREOF TO THE CONTINUOUS FEED OF AN ELECTROLYSIS CELL WITH SALTS OF SAID METAL

[75] Inventors: Marcel Armand, Meylan; Jean-Pierre Garnier, Rugles, both of France

[73] Assignee: Pechiney, Paris, France

[21] Appl. No.: 839,131

[22] Filed: Mar. 12, 1986

[30] Foreign Application Priority Data

Mar. 28, 1985 [FR] France ..... 85 05196

[51] Int. Cl.[4] ..... C25C 3/26; C25C 3/28

[52] U.S. Cl. ..... 204/64 R; 204/64 T; 204/245

[58] Field of Search ..... 204/64 T, 64 R, 245

[56] References Cited

U.S. PATENT DOCUMENTS 2,828,251 3/1958 Sibert et al. ..... 204/64 T 2,975,111 3/1961 Reimert et al. ..... 204/64 T

*Primary Examiner*—Howard S. Williams

*Attorney, Agent, or Firm*—Dennison, Meserole, Pollack & Scheiner

[57] ABSTRACT

A process for measuring the potential of an indicator electrode of a transition metal, which dips into a bath of molten chlorides disposed in an electrolytic cell relative to a reference electrode. It is characterized by introducing into the bath an amount of alkali metal and/or alkaline earth fluorides such that the molar ratio of the fluorine contained in the bath to the amount of dissolved transitions metal is between 4 and 8.

5 Claims, 3 Drawing Figures

Figure 1:
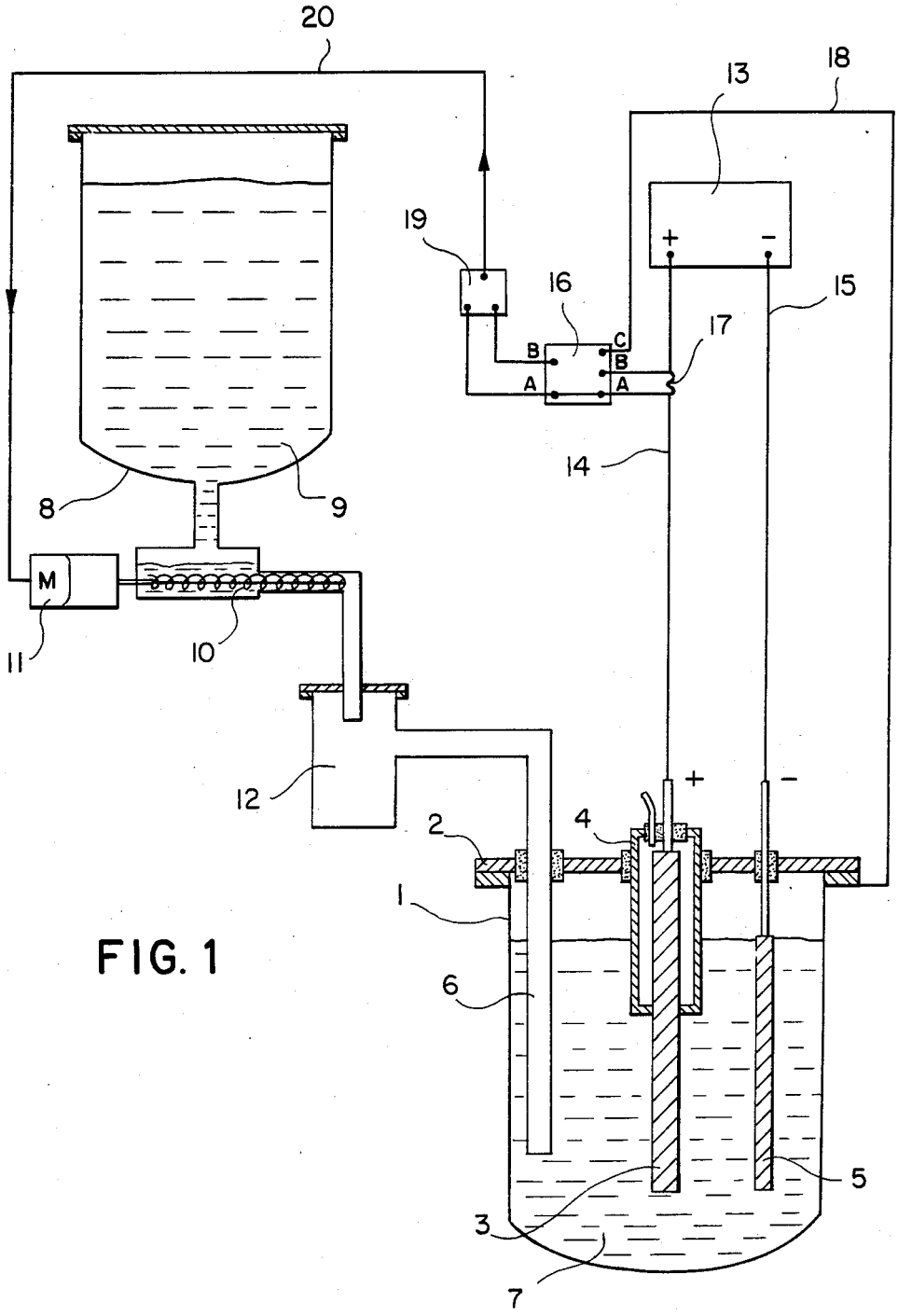

PROCESS FOR CONTINUOUSLY CONTROLLING THE PROPORTION OF METAL DISSOLVED IN A BATH OF MOLTEN SALTS AND THE APPLICATION THEREOF TO THE CONTINUOUS FEED OF AN ELECTROLYSIS CELL WITH SALTS OF SAID METAL

The present invention which results from the work done in the laboratories of the Ecole Nationale Supérieure d'Electrochimie et d'Electrométallurgie (National College of Electrochemistry and Electrometallurgy) in Grenoble, relates to a process for continuously controlling the proportion of transition metal dissolved in a bath of molten salts, and to the application thereof to the continuous feed of an electrolysis cell with salts of said metal.

The man skilled in the art is aware that it is possible on an industrial scale to produce transition metals by continuous electrolysis in a cell of at least one of their chlorides previously dissolved in a bath of molten salts formed by alkali metal and/or alkaline earth chlorides.

The term transition metal means in this context any metal falling in groups IVb, Vb and VIb of the periodic table and in particular titanium, zirconium, hafnium, tantalum, niobium and vanadium.

The term continuous electrolysis means a process in which deposit and extraction of the metal at the cathode and the production of chlorine at the anode are permanently compensated by a make-up supply of fresh chloride, the make-up supply being intended to maintain the proportion of metal to be produced, which is dissolved in the bath, at a relatively constant value which is preferably the optimum, that is to say, the value which is most favourable for proper operation of the cell.

In such a process, if the proportion of dissolved metal is effectively to be maintained at a constant value, the cell must be fed with an amount of fresh chlorides that precisely corresponds to the amount consumed by the cell.

In theory, as that amount is proportional to the amount of metal deposited at the cathode and therefore the amount of electrical current which flows through the cell, it seems logical at first glance to use measurements in respect of the strength of the electrolysis current and the amount of time which has passed, in order to determine the amount of chlorides to be introduced into the cell. In actual fact, because of inevitable fluctuations in the current used, in the feed of chloride of the metal and the level of efficiency, it is found that such a method results in variations in the amount of dissolved metal, relative to the optimum value, which increase in proportion to an increasing operating time of the cell. It is for that reason that it is found to be necessary to have recourse to other ways of effectively controlling the proportion of dissolved metal in the bath.

The solution which is generally adopted comprises periodically taking samples from the bath, analyzing them, and consequentially adjusting the amounts of chloride of the metal which are to be introduced into the bath. However, that operation is not a simple one and in particular it does not provide for an immediate response so that the variations in the amount of dissolved metal are reduced more or less periodically, and the amount of chloride of the dissolved metal in the bath is rarely equal to the optimum value.

A solution which is a more attractive proposition in the sense that it permits continuous control of the composition of the bath and therefore a substantial reduction in the variations in the proportion of dissolved metal has also been proposed. That method consists of using indicator electrodes of the dissolved metal, which are formed by a rod of the metal to be deposited and which are dipped into the bath of salts. In fact, those electrodes normally assume a potential which depends on the amount of dissolved metal in the bath. It is then only necessary to measure that potential with respect to a reference electrode in order to find out the amount which is to be controlled. Unfortunately, it is found that, with a variation by a factor of 10 in the amount of dissolved metal, the variation in potential does not exceed a few tens of mV, which is highly inadequate in regard to permitting precise control.

Having sought to improve the sensitivity of such a process, the applicants found that, in a range in respect of the amounts of dissolved transition metal generally used in electrolysis baths, that is to say, between 1 and 10% by weight, it was possible substantially to amplify the variation in the above-indicated potential by adding relatively small amounts of certain ions to the bath.

Thus, the applicants developed a process characterised by introducing into the bath an amount of alkali metal and/or alkaline earth fluorides such that the molar ratio of the fluorine contained to the amount of transition metal dissolved in the bath is between 2.5 and 15. However, values of between 4 and 8 give much higher levels of sensitivity. Such an addition makes it possible to obtain a variation in potential of several hundreds of millivolts for a variation of + or −2.5% in the amount of dissolved metal, which permits that amount to be precisely controlled.

In a practical situation therefore, with the optimum amount of metal for guaranteeing good operation of the cell being known, the process comprises calculating the amount of fluorides to be added, on the basis of the optimum amount of metal and the molar ratio claimed. The fluoride is introduced into the bath at the time of making it up.

The cell being fitted with an indicator electrode and a reference electrode, the optimum amount of chloride of the transition metal to be deposited is charged into the cell and, after a sufficient period of time to permit dissolution, the potential is measured, before starting electrolysis in the true sense. The proportion of dissolved metal can be confirmed by analysis of the bath.

The cell is then brought into service and regular operation can be achieved by feeding it with chlorides of the metal in such a way that the measured potential remains constant. The use that can be made of such measurement for the purposes of continuously feeding the cell will be easily recognized. In fact it is only necessary to compare the potential as measured at each moment to the reference potential corresponding to the optimum content of the bath, and to control the feed of chlorides to the cell in consequence thereof. In that way it is possible to provide for very fine regulation of the flow rate of chlorides of the metal, and to have a proportion of dissolved metal which is extremely accurate, throughout the electrolysis operation.

It may be that it is not easy to incorporate an indicator electrode and a reference electrode into the cell, and it is for that reason that the applicants sought to use the means already existing in conventional cells.

When the internal wall of the cell is metal, it was found that it was possible to use it as the indicator electrode. In fact, as it is known that the above-mentioned wall must be formed by the metal to be deposited, the attempt was made in the course of a pre-electrolysis operation in the presence of the chloride of the metal to be deposited, to pass a direct current between the anode of the cell and the wall of the tank. Under those conditions, it was found that the deposit of metal obtained on the tank is subsequently perfectly suited to act as an indicator electrode. If necessary, the deposit of metal on the wall may be periodically reconstituted in the course of the electrolysis operation or even permanently created by cathodic polarization of the tank.

The applicants also sought to eliminate the installation of a reference electrode, and they achieved that aim by substituting therefor the anode of the cell. However, in that case, an ohmic drop due to the electrolysis current I passing through the anode is then produced in the potential control circuit. That drop interferes with the measurement operation and gives defective information regarding the actual amount of dissolved chlorides in the bath. It is for that reason that the applicants incorporate an ohmic drop corrector between the indicator electrode and the anode, the constitution of that corrector being described hereinafter.

Figure 2:
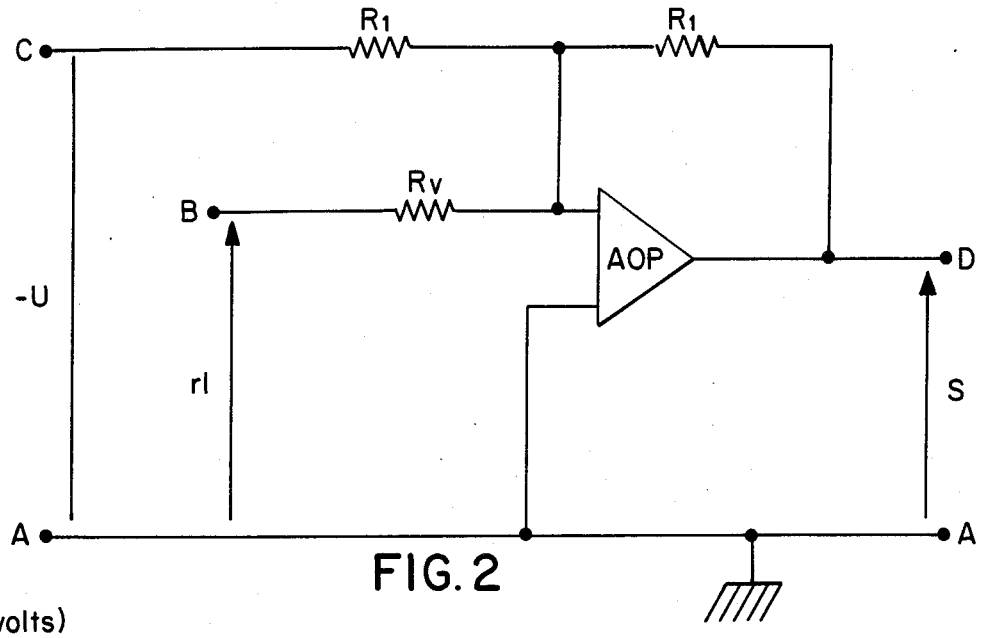
Figure 3:
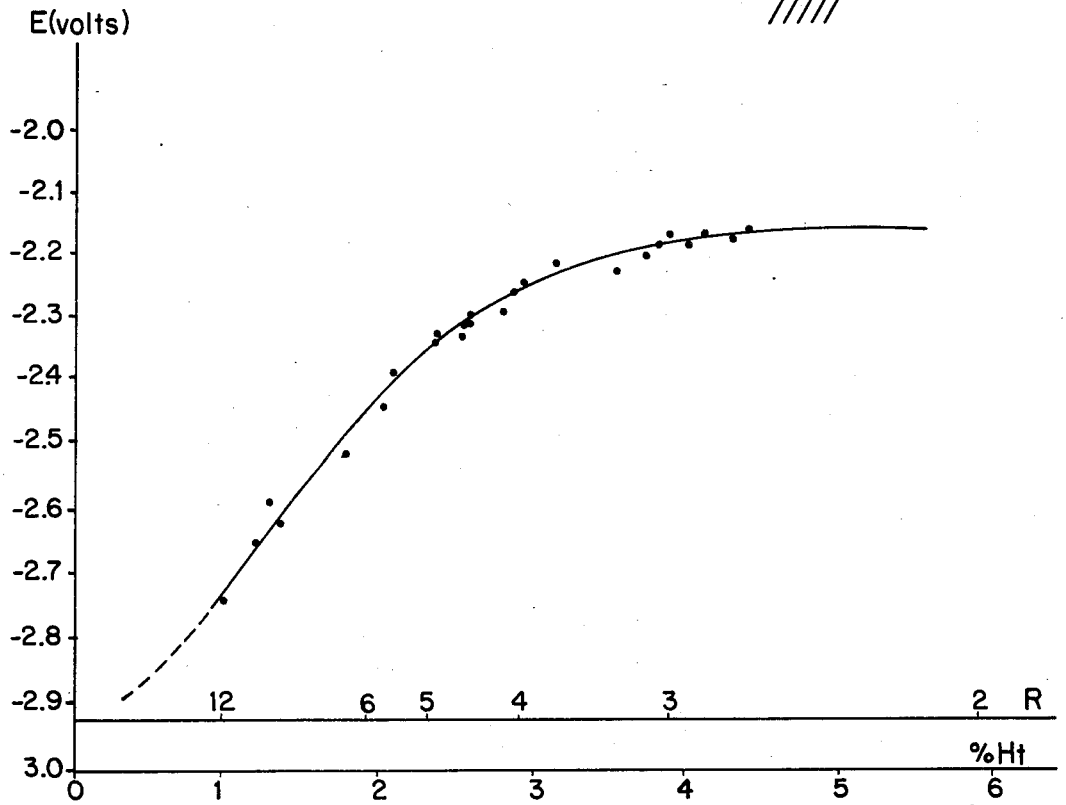

The invention will be better appreciated by reference to the accompanying drawings in which:

FIG. 1 is a diagrammatic view showing an electrolysis cell used for the production of hafnium, with its system for providing a feed of chlorides, in which the process according to the invention is carried out by means of an indicator electrode formed by the electrolysis tank and a reference electrode formed by the anode and an ohmic drop corrector, FIG. 2 is a diagrammatic view of the ohmic drop corrector, and FIG. 3 shows a curve in respect of the variation in the potential E of the tank (indicator electrode) with respect to reference (anode+corrector) in dependence on the proportion of hafnium dissolved in the bath.

Referring to FIG. 1, shown therein are the following:

1. an electrolysis cell formed by a metal tank 1 closed by a sealed cover 2 on which are fixed an anode 3 provided with a bell member 4 for recovery of the chlorine which is given off, a cathode 5 and a pipe 6 for a feed of gaseous hafnium chlorides; each of those components is immersed in the bath of salts formed by a mixture of potassium and sodium chlorides.
2. a feed system comprising a closed container 8 containing the hafnium chloride in powder form as indicated at 9, and provided at its base with a pipe communicating with an endless screw 10 driven by a motor 11 for transporting the chloride from the container 8 to a vaporiser 12 which communicates with the pipe 6.
3. the system for supplying electrical power to the cell, controlling the potential and controlling the feed of chlorides to the cell, comprising:
   - a direct current source 13 whose positive terminal is connected to the anode of the cell and whose negative terminal is connected to the cathode of the cell respectively by conductors 14 and 15;
   - an ohmic drop corrector 16 connected on the one hand to the conductor 14 by way of terminals A and B of a shunt 17 and on the other hand to a condcutor 18 connected to the tank 1 by way of the terminal C;
   - the terminals A and D of the device 16 are connected to a comparator 19 for comparing the measured potential to the reference potential, which passes a signal by way of the conductor 20 to the motor 11 when the measured potential is higher in terms of absolute value than the absolute value of the reference potential.

FIG. 2 shows the ohmic drop corrector comprising an operational amplifier designated as AOP, two resistors R1 of the same value, and a variable and regulatable resistor Rv. A voltage U is measured between the anode and the indicator electrode (tank of the cell), terminals A and C, the voltage U comprising the potential E which is to be found out plus an ohmic drop term R.I. The above-indicated voltage is written as follows: U=E+RI. R is a constant resistance which depends only on the geometry, nature and temperature of the molten bath.

To extract the term RI irrespective moreover of the value of I, we shall measure a voltage proportional to I, of a value rI, by means of a shunt r, indicated at 17 in FIG. 1.

The laws in respect of grids and nodes when applied to the circuit of FIG. 2 give as a result for the output voltage S:

$$S=U-(R1.r/Rv)I$$

that is to say $$S=E+(R-R1.r/Rv)I$$

At the beginning of operation, a calibration step is carried out which consists of regulating the value of Rv in such a way as to give the following:

$$R=R1.r/Rv$$

At that moment, that then gives S=E which is independent of the value of I and therefore of the fluctuations therein and which depends only on the proportion of dissolved metal, as shown in FIG. 3.

The signal S is passed to the comparator 19.

FIG. 3 shows a curve representing the variations in potential E or S in volts of the tank (indicator electrode of hafnium) with respect to the anode corrected in respect of the ohmic drop (normal reference for chlorine) in dependence on the amount in % of Hf dissolved in the bath and the molar ratio R of the amount of fluorine to the amount of hafnium. The curve was drawn up using a molten equimolecular KCl, NaCl bath (56% KCl and 44% NaCl by weight), at 750° C., to which 1.1% of fluorine in the form of NaF (2.5% by weight) had been added. A variation in potential of 750 mV is found when the amount of hafnium dissolved in the bath goes from 0.5 to 5% by weight.

Other curves which are not shown herein show that, with an addition of 4.1% of fluorine, the same variation in potential is produced with a variation in the weight of hafnium of from 1 to 8%.

More generally, the maxima in variation and therefore accuracy are achieved with a molar ratio of fluorine to dissolved metal of between 4 and 8 but results which are still highly acceptable can be obtained with ratios of between 2.5 and 15.

The invention can be used in all situations which involve producing transition metals by continuous electrolysis of chlorides thereof in molten baths of alkali metal or alkaline earth chlorides.

We claim:

1. A process for continuously controlling the proportion of transition metal dissolved in a bath of molten chlorides which is disposed in an electrolysis cell and which is intended for the production of said metal, from one at least of the chlorides thereof, wherein the potential of an indicator electrode of the transition metal which dips into the bath is measured with respect to a reference electrode, characterised by introducing into the bath an amount of alkali metal and/or alkaline earth fluorides such that the molar ratio of the fluorine contained in the bath to the amount of dissolved transition metal is between 2.5 and 15.

2. A process according to claim 1 characterised in that the molar ratio is between 4 and 8.

3. A process according to claim 1 characterised in that the indicator electrode comprises the metal wall of the cell on which transition metal has been deposited.

4. A process according to claim 1 characterised in that the reference electrode is formed by the anode of the electrolysis cell, provided with an ohmic drop corrector.

5. Use of the process of claim 1 for the continuous feed of chloride of the transition metal to the cell, characterised by comparing the measured potential to a reference potential corresponding to the optimum amount of transition metal chloride in the bath and providing for a feed as long as the measured potential remains in terms of absolute value higher than the absolute value of the reference potential.

* * * * *